US010138692B2

(12) United States Patent
Boyd

(10) Patent No.: US 10,138,692 B2
(45) Date of Patent: Nov. 27, 2018

(54) METHOD AND APPARATUS FOR CONTROLLING THE FLOW OF WELLBORE RETURNS

(71) Applicant: WEATHERFORD TECHNOLOGY HOLDINGS, LLC, Houston, TX (US)

(72) Inventor: Michael Boyd, Nisku (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 1327 days.

(21) Appl. No.: 13/872,713

(22) Filed: Apr. 29, 2013

(65) Prior Publication Data

US 2014/0318772 A1 Oct. 30, 2014
US 2016/0168932 A9 Jun. 16, 2016

Related U.S. Application Data

(60) Provisional application No. 61/639,455, filed on Apr. 27, 2012.

(51) Int. Cl.

| | |
|---|---|
| ***E21B 21/01*** | (2006.01) |
| ***E21B 21/00*** | (2006.01) |
| ***E21B 21/08*** | (2006.01) |
| ***E21B 21/06*** | (2006.01) |
| ***E21B 21/10*** | (2006.01) |

(52) U.S. Cl.

CPC ..... *E21B 21/00* (2013.01); *E21B 21/01* (2013.01); *E21B 21/063* (2013.01); *E21B 21/067* (2013.01); *E21B 21/08* (2013.01); *E21B 21/106* (2013.01); *E21B 2021/007* (2013.01)

(58) Field of Classification Search

CPC ..... E21B 21/067; E21B 21/106; E21B 21/08; E21B 2021/007; E21B 21/063; E21B 21/10; E21B 43/12

See application file for complete search history.

(56) References Cited

U.S. PATENT DOCUMENTS

| | | | | |
|---|---|---|---|---|
| 2,786,652 A * | 3/1957 | Wells | E21B 21/12 175/206 |
| 3,213,939 A * | 10/1965 | Records | E21B 21/08 166/267 |
| 6,413,065 B1 | 7/2002 | Dass | |
| 2007/0151762 A1* | 7/2007 | Reitsma | E21B 21/08 175/40 |
| 2010/0147591 A1* | 6/2010 | Pomerleau | E21B 21/08 175/61 |
| 2013/0206423 A1* | 8/2013 | Weinstock | E21B 7/12 166/358 |

* cited by examiner

*Primary Examiner* — Brad Harcourt
(74) *Attorney, Agent, or Firm* — Smith IP Services, P.C.

(57) ABSTRACT

A method and apparatus to regulate the down-hole hydrostatic pressure in a wellbore are provided which depend on regulating the resistance to the flow of wellbore returns produced by the wellbore. The resistance may be provided by the internal gas pressure in a gas/liquid separator receiving the flow of wellbore returns, where the internal gas pressure is regulated by an adjustable back pressure valve and a gas source. Alternatively or in addition, the resistance may be provided by a pump receiving the flow of wellbore returns, where the resistance of the pump is regulated by adjusting the speed of the pump.

16 Claims, 2 Drawing Sheets

METHOD AND APPARATUS FOR CONTROLLING THE FLOW OF WELLBORE RETURNS

CROSS REFERENCE TO RELATED APPLICATION

This application claims the priority benefit of U.S. Provisional Patent Application No. 61/639,455 filed on Apr. 27, 2012 entitled "Method and Apparatus for Controlling the Flow of Well Bore Returns", the contents of which are incorporated herein by reference.

FIELD OF THE INVENTION

The present invention is directed to oil and gas drilling operations, and in particular to an apparatus and method for controlling the flow of wellbore returns.

BACKGROUND

During drilling operations, drilling fluid or drilling mud, is pumped down the drill string in the wellbore using what are known as mud pumps. The drilling fluid jets out of the drill bit and cleans the bottom of the hole. The drilling fluid moves back up the wellbore in the annular space between the drill sting and the side of the wellbore, flushing cuttings and debris to the surface. The returning drilling fluid provides hydrostatic pressure to promote the prevention of formation fluids from entering into the wellbore. Drilling fluids are also typically viscous or thixotropic to aid in the suspension of cuttings in the wellbore, both during drilling and during interruptions to drilling.

The mixture of drilling fluid, formation fluids, cuttings and debris travelling back up the wellbore to the surface is referred to as the 'wellbore returns' or 'drilling returns'. The wellbore returns may also contain dissolved gas which moves from the surrounding formation being drilled into the drilling fluid in the annulus.

Upon arrival at the surface, a series of valves and pipes are utilized to controllably direct the wellbore returns to either a mud/gas separator or to a de-gasser. A separator typically comprises a cylindrical or spherical vessel and can be either horizontal or vertical. It is used to separate gas from the drilling fluid and gas mixture. In the separator, the mixture is usually passed over a series of baffles designed to separate gas and mud. Liberated free gas is moved to a flare line and the mud is discharged to a shale shaker and to a mud tank. A de-gasser is used when the gas content of the drilling fluid is relatively lower and it operates on much the same principles as the separator. A vacuum is applied to the fluid as it is passed over the baffles to increase surface area, thereby promoting the liberation of dissolved gas.

During drilling operations, it is important to maintain constant down-hole hydrostatic pressure to prevent formation fluids from entering into the wellbore as mentioned above. This can be challenging due to shifting wellbore conditions and interruptions to drilling operations, such as tripping pipe. To maintain down-hole hydrostatic pressure, conventional drilling operations utilize one or more chokes at the well head. The primary role of the choke is to regulate the flow of wellbore returns from the well head. The choke comprises an adjustable orifice that can be opened or closed to control the flow rate of the wellbore returns, which in turn regulates down-hole pressure. There are both fixed and adjustable chokes, the latter being more conducive to enabling the fluid flow and pressure parameters to be adjusted to suit process and production requirements. However, the chokes, whether fixed or adjustable, are prone to wear, erosion and becoming clogged with cuttings and debris. Further, the chokes do not accurately measure wellbore return volume.

There is a need in the art for an apparatus and a method of controlling wellbore returns to regulate down-hole hydrostatic pressure that may mitigate the problems of existing choke devices, or provide an alternative to existing choke devices.

SUMMARY OF THE INVENTION

In one aspect, the present invention provides a method of controlling a flow of wellbore returns to regulate the down-hole hydrostatic pressure of a wellbore, the method comprising the steps of:

(a) directing the flow of wellbore returns through an intake flow line from the wellbore into a gas/liquid separator having a gas outlet;

(b) separating gas associated with the wellbore returns to produce a disassociated gas in the separator; and (c) selectively restricting the flow of the disassociated gas out of the separator through the gas outlet to regulate the internal gas pressure of the separator, wherein the internal gas pressure of the separator is opposed to the flow of the wellbore returns through the intake flow line from the wellbore into the separator.

In one embodiment, the method further comprises the step of introducing gas into the separator from a gas source to increase the internal gas pressure of the separator.

In another aspect, the present invention provides a method of controlling a flow of wellbore returns to regulate the down-hole hydrostatic pressure of a wellbore, the method comprising the steps of:

(a) directing the flow of wellbore returns through an intake flow line from the wellbore to a pump, and through the pump; and (b) selectively varying the speed of the pump to vary the resistance of the pump to the flow of wellbore returns through the intake flow line from the wellbore to the pump.

In one embodiment, the pump is a multiphase pump, a positive displacement pump, a twin screw pump, a centrifugal pump, or a diaphragm pump. In one embodiment, the method further comprises the step of measuring the volume of wellbore returns passing through the pump.

In another aspect, the present invention provides an apparatus for controlling a flow of wellbore returns to regulate the down-hole hydrostatic pressure of a wellbore. The apparatus comprises an intake flow line, a gas/liquid separator, and a back pressure valve. The intake flow line receives the flow of wellbore returns from the wellbore. The gas/liquid separator has an inlet for interconnection to the intake flow line for receiving the flow of wellbore returns, and a gas outlet. The back pressure valve is interconnected to the gas outlet and is adjustable to selectively restrict the flow of gas out of the separator and thereby regulate the internal gas pressure of the separator opposed to the flow of wellbore returns through the intake flow line from the wellbore into the separator.

In one embodiment, the apparatus further comprises a gas source interconnected to the separator.

In another aspect, the present invention provides an apparatus for controlling a flow of well bore returns to regulate the down-hole hydrostatic pressure of a wellbore. The apparatus comprises an intake flow line, and a pump.

The intake flow line receives the flow of wellbore returns from the wellbore. The pump has a pump inlet interconnected to the intake line for receiving the flow of wellbore returns, and a pump outlet for discharging the flow of wellbore returns. The speed of the pump is adjustable to selectively vary the resistance of the pump to the flow of wellbore returns through the intake flow line from the wellbore to the pump.

In one embodiment, the pump is a multiphase pump, a positive displacement pump, a twin screw pump, a centrifugal pump, or a diaphragm pump.

In one embodiment, the apparatus further comprises a gas/liquid separator and a back pressure valve. The gas/liquid separator has a separator inlet and a gas outlet, the separator inlet being interconnected to the intake flow line for receiving the flow of wellbore returns. The back pressure valve is interconnected to the gas outlet and is adjustable to selectively restrict the flow of gas out of the separator and thereby regulate the internal gas pressure of the separator opposed to the flow of wellbore returns though the intake flow line from the wellbore into the separator.

In one embodiment, the apparatus further comprises an intake valve interconnected to the intake flow line for selectively restricting the flow of wellbore fluids through the intake flow line from the wellbore to either the pump, or the separator, or both.

In one embodiment, the apparatus further comprises a gas source interconnected to the separator.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to an apparatus and a method of controlling the flow of wellbore returns to regulate the hydrostatic force in a wellbore. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

As used herein, the term "down-hole hydrostatic pressure" means the pressure exerted at any given point in the wellbore by the column of fluid above that point, including any pressure exerted at the surface by the apparatuses described herein.

Figure 1:
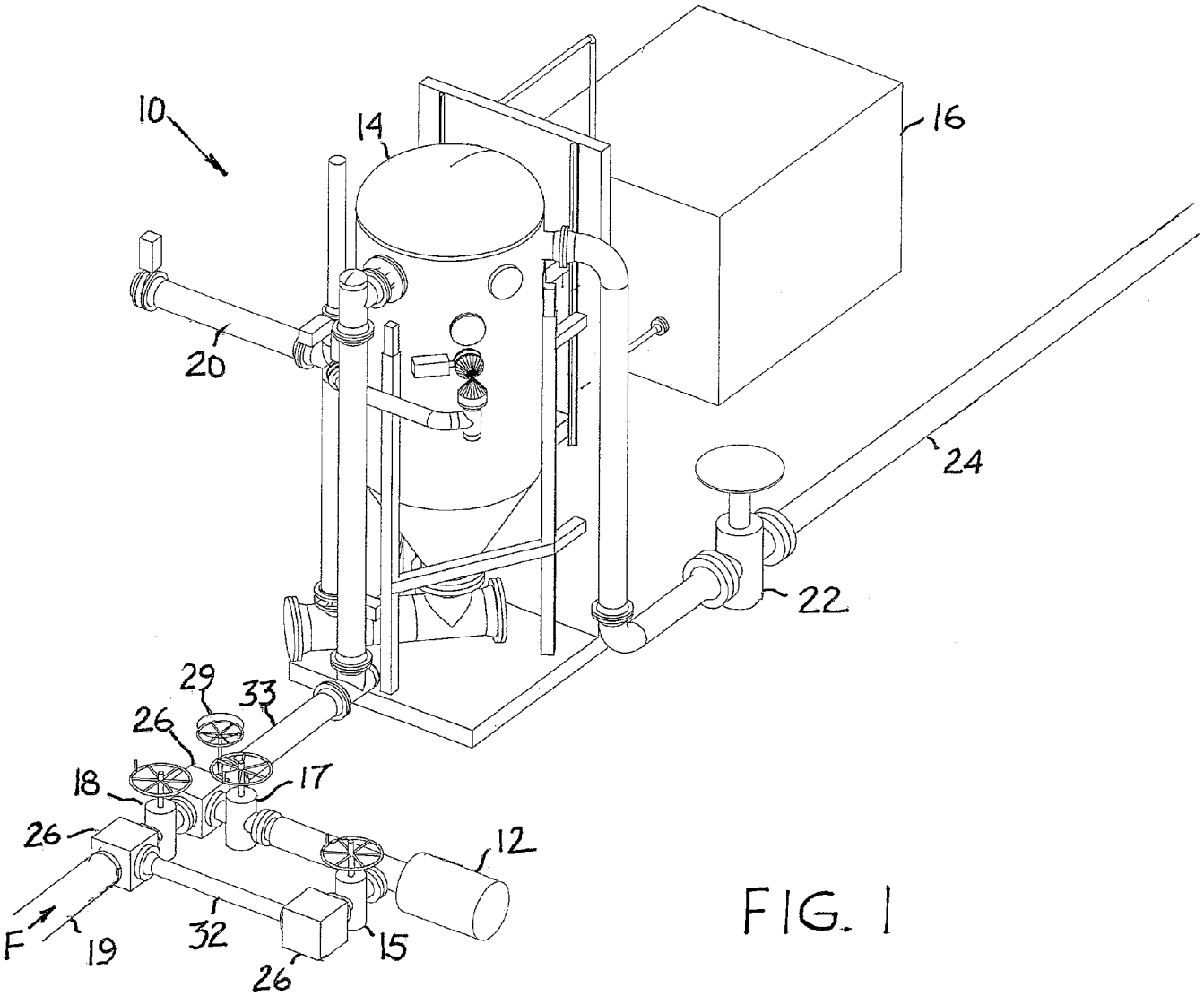
FIG. 1 is an elevated diagrammatic depiction of one embodiment of the present invention.

FIG. 1 depicts one embodiment of the apparatus (10) of the present invention. The apparatus (10) can be utilized to control and exert a selected pressure back on the wellbore, thus controlling the hydrostatic pressure on the formation surrounding the wellbore, the inflow of fluids from the surrounding formation into the wellbore, and the flow of the drilling fluid. In one embodiment, the apparatus (10) will also allow an operator to measure the volume of wellbore returns passing through the apparatus (10).

Referring to FIG. 1, an intake flow line (19) receives the wellbore return flow (F) that is diverted from the blow-out-preventer ("BOP") stack (not shown) at the wellhead. In one embodiment, a diversion manifold (26) provides two alternate flow paths for the wellbore returns which can be interchangeably selected by selectively opening and closing gate valves (18, 15, 17).

In further embodiments of the present invention, the diversion manifold (26) may be substituted for a rotating flow control diverter ("RFCD") or rotating blow out preventer ("RBOP"). The gate valves (18, 15, 17) may also be closed to block the flow of wellbore returns if required for safety purposes. As shown in FIG. 1, a choke valve (29) may be used with the present apparatus (10) and may be employed to quickly kill flow of the wellbore returns if required. It should be understood that the choke valve (29) is present for safety purposes only and is not essential to the method of or apparatus for controlling the down-hole hydrostatic pressure described herein.

The first flow path leads directly to the separator flow line (33) which is connected to a gas/liquid separator (14). Any suitable separator (14) may be used with the present invention provided that it has an adequate volume and pressure rating. In one embodiment, a gas source (16) is interconnected to the separator (14). The gas source (16) may consist of any suitable equipment capable of providing on-site generated nitrogen, liquid nitrogen, natural gas, propane or carbon dioxide, as is well known in the art. A liquid outlet line (20) may lead from the separator (14) to a tank (38) or de-gasser (36) or to a shaker (34) (shown in FIG. 2). A gas outlet line (24) leads from the separator (14) to a flare stack (not shown in the Figures). The gas outlet line (24) has an integral back pressure valve (22).

A second flow path follows the pump flow line (32) to a pump (12). The pump (12) can be any suitable pump that can be used to control the flow of the wellbore returns, including without limitation, a multiphase pump, a positive displacement pump, a twin screw pump, a centrifugal pump or a diaphragm pump. A fluid flow meter (not shown) may be associated with or integral with the pump. In one embodiment, a twin screw pump is used as it easily facilitates accurate measurement of the volume of the wellbore returns passing through it.

Operation of the apparatus (10) depicted in FIG. 1 will now be described. If an operator elects to flow the wellbore returns directly into the separator (14) from the BOP stack, the gate valves (15, 17) on both sides of the pump (12) are closed, while the gate valve (18) and the choke valve (29), if present, mounted on the separator flow line (33) are opened thereby directing flow of the wellbore returns directly along the separator flow line (33) into the separator (14). Gas is separated from the wellbore returns in the separator (14). The back pressure valve (22) can be used to restrict the flow of gas out of the separator (14) into the gas outlet line (24). This causes an increase of the internal gas pressure in the separator (14) which inhibits the flow of the wellbore returns into the separator (14) from the separator flow line (33). The restricted flow of wellbore returns results in back pressure on the wellbore and an increase in down-hole hydrostatic pressure. In this manner, the down-hole hydrostatic pressure can be controlled and maintained at a constant level by the back pressure valve (22) on the gas outlet line (24).

In the event, that the wellbore returns do not have sufficient associated gasses to create the required back pressure in the separator (14) to restrict the flow of the wellbore returns into the separator (14), then the internal pressure of the separator (14) can be artificially increased as required by the introducing gas into the separator (14) from the gas source (16).

If the operator elects to flow the wellbore returns through the pump (12) from the BOP stack, then the gate valve (18) mounted on the separator flow line (33) will be closed and the gate valves (15 and 17) on both sides of the pump (12) and the choke valve (29), if present, will be opened. The flow of wellbore returns is accordingly directed through the pump flow line (32) into an inlet of the pump (12). The flow of the wellbore returns through the pump (12) can be restricted in a controlled manner by controlling the speed at which the pump (12) runs. The faster the pump (12) runs, the less that the pump (12) restricts the flow of wellbore returns. Conversely, the slower the pump (12) runs, the more that the pump (12) restricts the flow of wellbore returns. Inhibition of the flow of the wellbore returns results in back pressure on the wellbore and an increase in down-hole hydrostatic pressure. In this manner the down-hole hydrostatic pressure can be controlled and maintained at a constant level by the varying the speed or revolutions per minute ("rpm") of the pump (12), as required. For example, if the down-hole hydrostatic pressure increases beyond a desirable level, then the speed of the pump (12) can be increased to lower the back pressure, thereby lowering the down-hole hydrostatic pressure. The flow of wellbore returns exits the pump (12) though a pump outlet and is directed to the separator flow intake line (33) (as shown in FIG. 1).

Use of a pump (12) also provides the operator with the means to accurately calculate the return volume of the wellbore returns. Such information is important to the operator who is continuously trying to achieve a net balance of liquid injection and liquid returns during operations.

Figure 2:
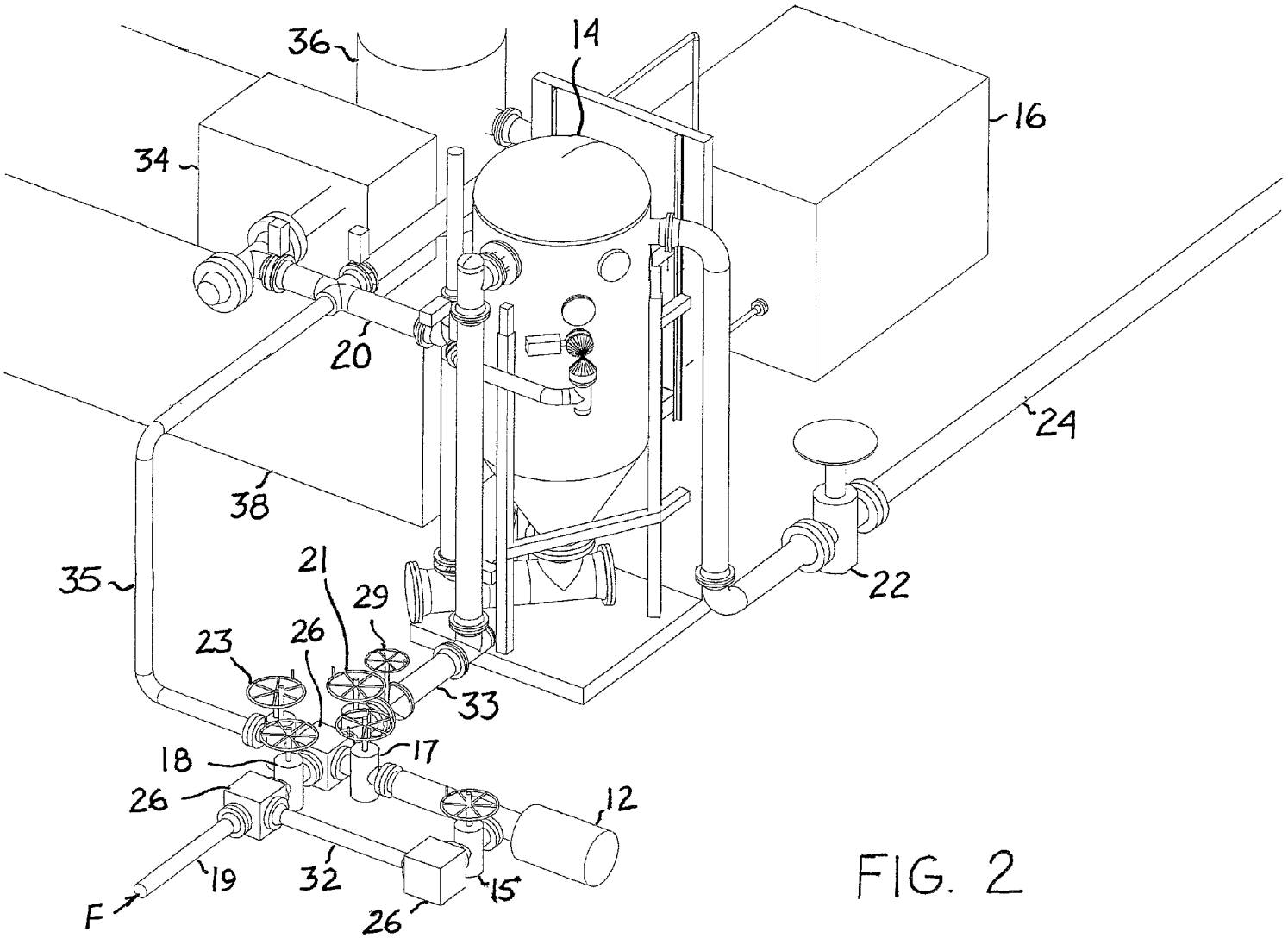
FIG. 2 is an elevated diagrammatic depiction of another embodiment of the present invention.

While FIGS. 1 and 2 depict embodiments of the apparatus (10) having both a pump (12) and a separator (14), one skilled in the art will appreciate that the present invention can be practiced using a pump (12) without a separator (14), or using a separator (14) without a pump (12).

In the embodiment depicted in FIG. 2, an additional flow line (35) and additional gate valves (23, 21) may be utilized which allows the operator to direct the wellbore returns directly to a de-gasser (36), a shaker (34) or to a rig tank (38) without having to pass through the separator (14). Using the apparatus (10) shown in FIG. 2, an operator could selectively run the wellbore returns through the pump (12) and then directly to the de-gasser (36) and the shaker (34) by closing the gate valve (21) mounted on the separator flow line (33) and by opening the gate valve (23) on flow line (35).

It should also be understood that the pump (12) and the separator (14) may be used independently to control the flow of the wellbore returns, or they may also be used cooperatively to control the flow of wellbore returns.

As will be apparent to those skilled in the art, various modifications, adaptations and variations of the foregoing specific disclosure can be made without departing from the scope of the invention claimed herein.

What is claimed is:

1. A method of controlling a flow of wellbore returns and regulating a down-hole hydrostatic pressure of a wellbore, the method comprising:

directing the flow of wellbore returns through an intake flow line into a gas/liquid separator; and in response to the wellbore returns lacking a desired level of associated gases, introducing a supplemental gas into the separator from a supplemental gas source, thereby controlling the flow of wellbore returns into the separator and regulating the down-hole hydrostatic pressure of the wellbore while the wellbore is being drilled.

2. The method of claim 1, further comprising separating the gases from a remainder of the wellbore returns, thereby producing a disassociated gas in the separator.

3. The method of claim 2, further comprising selectively restricting flow of the disassociated gas out of the separator through a gas outlet, thereby regulating an internal gas pressure of the separator.

4. The method of claim 3, wherein the internal gas pressure of the separator impedes the flow of the wellbore returns through the intake flow line from the wellbore into the separator.

5. The method of claim 1, wherein the directing further comprises directing the flow of wellbore returns through the intake flow line from the wellbore to an inlet of a pump.

6. The method of claim 5, further comprising selectively varying a speed of the pump, thereby varying a resistance of the pump to the flow of wellbore returns through the intake flow line into the inlet of the pump.

7. The method of claim 6, wherein the directing further comprises directing the flow of wellbore returns from an outlet of the pump to the separator.

8. The method of claim 7, wherein the intake flow line is hydraulically isolated from the outlet of the pump.

9. The method of claim 5, further comprising installing the pump in close proximity to a choke valve which selectively restricts the flow of wellbore returns through the intake flow line.

10. A method of controlling a flow of wellbore returns and regulating a down-hole hydrostatic pressure of a wellbore, the method comprising:

installing a pump in close proximity to a choke valve which selectively restricts the flow of wellbore returns through an intake flow line;

directing the flow of wellbore returns through the intake flow line from the wellbore to an inlet of the pump;

selectively varying a speed of the pump, thereby varying a resistance of the pump to the flow of wellbore returns through the intake flow line into the inlet of the pump; and directing the flow of wellbore returns from an outlet of the pump to at least one piece of equipment selected from the group consisting of a separator, a de-gasser, a shaker, and a tank, wherein the intake flow line is hydraulically isolated from the outlet of the pump.

11. The method of claim 10, wherein the pump is a multiphase pump, a positive displacement pump, a twin screw pump, a centrifugal pump, or a diaphragm pump.

12. The method of claim 10, further comprising measuring a volume of wellbore returns passing through the pump.

13. An apparatus for controlling a flow of wellbore returns and regulating a down-hole hydrostatic pressure of a wellbore, the apparatus comprising:

an intake flow line for receiving the flow of wellbore returns from the wellbore;

a choke valve configured to selectively restrict the flow of wellbore returns through the intake flow line;

a pump positioned in close proximity to the choke valve, the pump having a pump inlet interconnected to the intake flow line for receiving the flow of wellbore returns, and a pump outlet for discharging the flow of wellbore returns, wherein a speed of the pump is adjustable to selectively vary a resistance of the pump to the flow of wellbore returns through the intake flow line into the pump inlet, and wherein the intake flow line is hydraulically isolated from the pump outlet.

14. The apparatus of claim 13, wherein the pump is a multiphase pump, a positive displacement pump, a twin screw pump, a centrifugal pump, or a diaphragm pump.

15. The apparatus of claim 13, further comprising:

a gas/liquid separator having a separator inlet and a gas outlet, the separator inlet being interconnected to the intake flow line for receiving the flow of wellbore returns; and a back pressure valve interconnected to the gas outlet, the back pressure valve being adjustable to selectively restrict a flow of gas out of the separator and thereby regulate an internal gas pressure of the separator.

16. The apparatus of claim 15, further comprising a gas source interconnected to the separator.

* * * * *